United States Patent [19]

Dauphin

[11] Patent Number: 4,662,680

[45] Date of Patent: May 5, 1987

[54] ACTIVATING DEVICE FOR THE RELEASE TAPPET OF A LONGITUDINALLY ADJUSTABLE GAS SPRING

[75] Inventor: Elke Dauphin, Offenhausen bei Nuremberg, Fed. Rep. of Germany

[73] Assignee: Buerositzmöbelfabrik Friedrich-W. Dauphin GmbH & Company, Nuremberg, Fed. Rep. of Germany

[21] Appl. No.: 786,824

[22] Filed: Oct. 11, 1985

[30] Foreign Application Priority Data

Oct. 24, 1984 [DE] Fed. Rep. of Germany ..... 3438843
Mar. 14, 1985 [DE] Fed. Rep. of Germany ..... 3509050

[51] Int. Cl.[4] ..... A47C 3/00
[52] U.S. Cl. ..... 297/300; 297/345
[58] Field of Search ..... 297/355, 313, 327, 300, 297/345

[56] References Cited

U.S. PATENT DOCUMENTS 3,712,666 1/1973 Stoll ..... 297/313
3,837,704 9/1974 Bauer ..... 297/345
4,076,308 2/1978 Salbon ..... 297/327
4,383,714 5/1984 Ishida ..... 297/327

FOREIGN PATENT DOCUMENTS 2757349 7/1979 Fed. Rep. of Germany ..... 297/300

*Primary Examiner*—James T. McCall
*Attorney, Agent, or Firm*—Browdy and Neimark

[57] ABSTRACT

An activating device for the release tappet of a longitudinally adjustable gas spring. The device is shiftable parallel to the longitudinal axis of the gas spring between a fixed and a release position, and comprises an activating lever fixable in two end pistons. A device connecting the piston of the gas spring with a first housing part of the activating contrivance is effected so that a release tappet projects into a first housing part by means of a ball beneath the release tappet. A second housing part is located beneath the first housing part and the ball in contact therewith. A pivotably stored activating lever section is provided with angularly transposed, coordinated recesses of different depths.

10 Claims, 5 Drawing Figures

ACTIVATING DEVICE FOR THE RELEASE TAPPET OF A LONGITUDINALLY ADJUSTABLE GAS SPRING

FIELD OF THE INVENTION

The invention relates to an activating device for the release tappet of a longitudinally adjustable gas spring.

BACKGROUND OF THE INVENTION

Operational devices for longitudinally adjustable gas springs are used in office chairs, especially to facilitate in a release position the relative motion of two chair parts to one another, corresponding to the body movements of the user, and secondly to be able to adjust optionally in a locking position a steady positioning of the two chair parts relative to one another.

In addition, the release tappet of the gas spring, which is placed in this longitudinally shiftable spring, can be secured in two different positions. In order to effect this, it is conventional to employ a control lever that acts on a release tappet and is adjustable in two different end positions by means of a crank guide.

SUMMARY OF THE INVENTION

Proceeding from this, the invention is based on the task of outfitting an operational device of the kind wherein the simplest manipulation of the operational lever becomes possible. This is possible in particular without a visual check or a coordination of the operational procedure. In addition, the mechanism is to facilitate a definable operation and secure setting of the end position by means of a simple and inexpensive construction.

The problem is solved by means of the present invention which provides an activating device for the release tappet of a longitudinally adjustable gas spring shiftable parallel to the longitudinal axis of the gas spring between a fixed and release position. The activating device comprises an activating lever, positionable in the two end positions, wherein a device comprising an external screw thread and an internal screw thread is provided for connecting the position of the gas spring with a first housing part of the activating contrivance in a manner such that the release tappet in the first housing part projects, by means of a ball, into the first housing part beneath the release tappet and, resting in contact with this ball by means of a second housing part, beneath the first housing part, and by means of pivotably situated activating lever section in the second housing part beneath the first housing part. The ball remains in contact with recesses, angularly offset to each other, of varying depths. By means of the arrangement of details, according to the invention, the manipulation of the operational device requires only a simple pivoting motion within a limited angular scope of about 90°. Such a movement can be executed without looking downward and without the need of any special attention on the part of the user of the office chair, if the user does not undertake a corresponding change of position too often. Precisely this is the presupposition, however, that the comfort made possible by the construction and the positioning possibilities for the user and the comfort connected with this are perceived.

In addition, the ball provided according to the invention glides relatively gently from one end position into the other, i.e. from one recess to the operational lever section into the other; in this instance it has, however, been seen that an inadvertent adjustment is avoided through the formation of a pronounced dead center position between the end positions.

The arrangement of details by the present invention, in particular in the use of an elbowed activating lever, makes possible the manipulation, i.e. the slackening of fixable gas springs in such a manner that a so-called biofeedback takes place, i.e. the desired mechanical movement result coincides in the main with the natural body movement, so that the inner resistance of the user against the mechanical manipulation, at first alien to him, is as slight as possible.

Through the arrangement of details in accordance with another embodiment of the present invention, the activating lever on the activating device can be simply installed, and no additional means for axial locking of the activating lever, however, are required, since at times the locking in the end position is accomplished through the intervening ball moving into a recess and acting as axial catch. In this embodiment, the activating lever section is stored in a cylindrical boring of the second housing part.

The supplied pivotal angle limitation in compliance with the present invention guarantees that the user of the activating lever at times meets with a definite end position, and that only predetermined active motions over the angle scope between the two recesses are possible, so that the user need not first orient himself on the relative position of the activating lever. The pivot angle limiting device for the activating lever is arranged for the activating lever in the second housing part.

The pivoting angle limitation device in accordance with another embodiment is developed in a particularly simple, and, at the same time, functionally very satisfying manner. The basic thought in this construction comprises a portion of the second housing part diverges from the round cross sectional form and serves as a stop for the flattened end of the activating lever section. Correspondingly, according to the invention, the supplied chordal limitation of the end of the cylinder bore, or the end of the fastening lever section need not necessarily run exactly linearly.

More specifically, the pivot angle limiting device is formed such that one end of the second housing part exhibits a diminishing cross section of the cylinder boring along the length of a circular chord, and the corresponding end of the activating device, intervening there, exhibits a limiting notch of such type that, between the limiting chord of the cylinder boring and the limiting chord of the end of the activating section, there remains a definable free play for the pivot angle.

By means of the measure wherein at least one end of the second housing part is formed as an unscrewable end part, an especially simple production and assembly of the second housing part is made possible.

The developed ring channel wherein the end part is unscrewable through the development of a ring groove makes possible the acceptance of a snap ring and by this means, in connection with a corresponding snap ring groove at the other end of the second housing part, a fastening of the same, e.g. in an office chair.

In another embodiment of the present invention, the clear opening of the end part is diminished by means of rolling.

In another embodiment, the first and second housing parts are made in cylindrical form and are welded together.

In another embodiment the connecting device is made as a threaded connection with a counter nut. By this means, an optimal adjustment of the activating points and a locking into position of this setting can be obtained.

A preferred application of the operating device according to the present invention is for damping the back rest pivotal movement in office chairs.

Further characteristics, advantages and details of the invention follow from the ensuing description of a preferred design form with the aid of the drawing.

DESCRIPTION OF THE PREFERRED EMBODIMENTS

Figure 1:
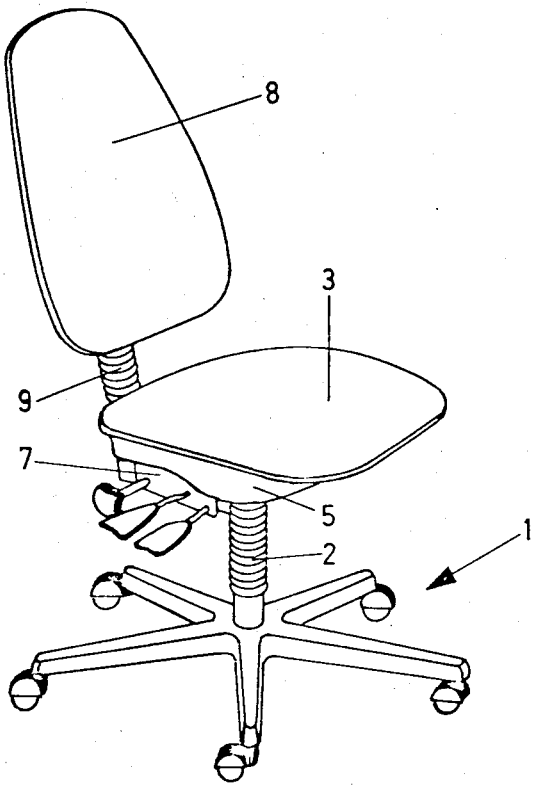
FIG. 1 is a side view of an office chair in which the operating device is employed, according to the invention.
Figure 2:
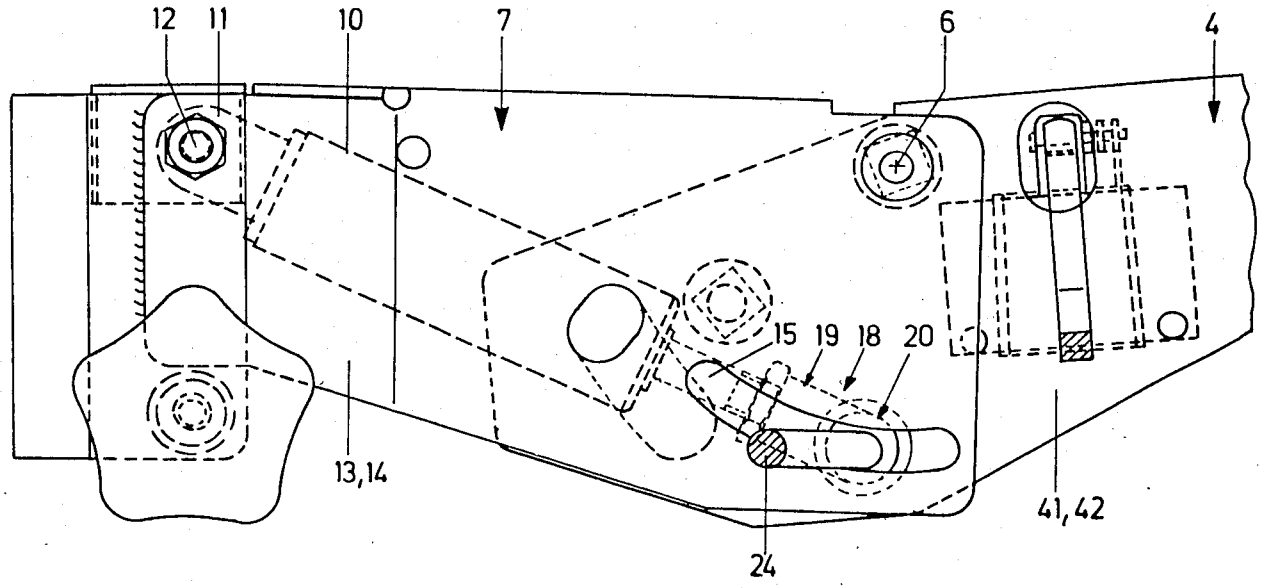
FIG. 2 is a side view, which shows the arrangement of an operating device, according to the invention, for damping of the pivotal movement of the back-rest support in a gas spring.

An office chair shown in FIG. 1 consists of a foot support 1 with a bearing column 2, which is connected with the receiving seat carrier 4 (see FIG. 2) bearing the upholstered seat 3. In FIG. 1 only the covering 5 of the seat carrier 4 is represented.

With the seat carrier 4, connected pivotably, around a pivoting axis 6 is a back support carrier part 7, to which the back support carrier support column 9, bearing the back support 8, is attached.

The housing side end of a gas spring 10 exhibits a ring collet 11, which is interspersed by a bolt 12 that is set into the side walls 13, 14 of the back support carrier part 7.

Figure 4:
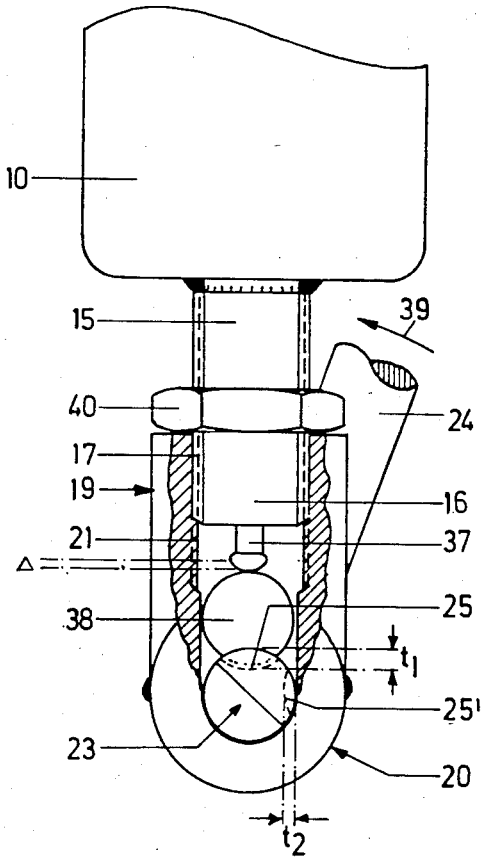
FIG. 4 is a partially sectional side view of the piston of a gas spring of the locking device, according to the invention, with the piston of a gas spring screwed on, and FIG. 5 is a view of the one end of the one housing part of the operating device, according to the invention.

Projecting from its housing at the other end of the gas spring 10 is the piston rod 15, the free end of which 16, is provided with an outside thread 17 (FIG. 4).

An activating device 18 exhibits a first and second housing part 19 and/or 20, which in the illustrated embodiment are developed in cylindrical form.

The first housing part 19 is with inside thread 21 into which the outside thread 17 of the piston rod 15 is screwed (FIG. 4).

Figure 3:
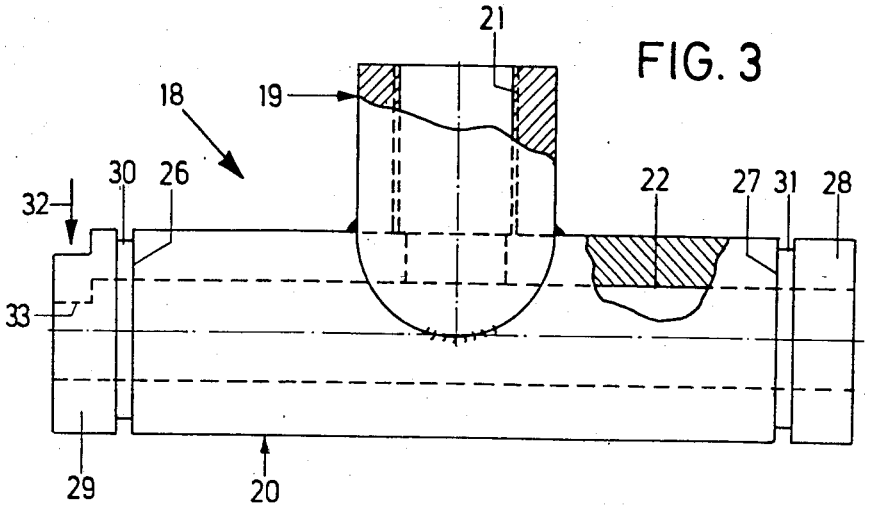
FIG. 3 is a side view of the housing of an operation device, according to the invention.

The second housing part 20 is supplied with an internal cylinder boring 22, in which a section 23 of an activating lever 24 is conducted (FIGS. 3 and 4).

The activating lever section 23 exhibits two recesses 24 and 25 of different depths, $t_1$ or $t_2$.

Figure 5:
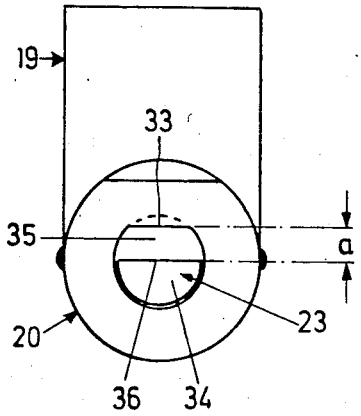

On the two frontal sides 26, 27 of the second housing part 20, end parts 28, 29 are for the time being unscrewed by ring grooves 30, 31 (FIG. 3). The one end part 29 is externally compressed in the direction of the arrow 32 in such manner, that, as is especially recognizable from FIG. 5, the originally circular shaped cross cut is lessened under the formation of a chord 33. The corresponding end 34 of the activating lever section 23 exhibits externally an outwardly open recess 35 in such a manner that an inter-space a arises in the recess 35 between chord 36 and chord 33, which makes possible a swivelling movement of the activating lever of section 23 of about 90°, by which a swivel angle limit is reached through this means, that, in the case of a twist from the position represented in FIG. 5, chord 36 strikes against chord 33. In the corresponding pivotal position to the right, complete to the point of striking, as represented in FIG. 4, the deeper recess 25 lies beneath piston 25, while in the corresponding left end position, the flatter recess 25' lies beneath piston 15.

At the lower end 16 of piston 15 an axially moveable release tappet 37 is provided (FIG. 4). Between the lower end of the release tappet 37 and the activating lever section 23, a ball 38 of such type is provided, that it stands in contact alternately with release tappet 37 and with the activating lever section 23.

Through a horizontal swing of the activating lever 24 out of the position represented in FIG. 4 in the direction of the arrow 39, ball 38 is first lifted out of the recess 25, so as to glide after a pivoting movement of 90° into the recess 25' with the depth $t^2$. The difference in depths t' minus t has, as a consequence, that the release tappet 37 is moved below by that amount of difference. This means, that through the "shifting" of one end position of the activating lever section 23 into the other of the release tappet 37, there can be movement from shift position (release-lock) into the other, in which case there is stability in both end positions.

Since the ball 38 is fixed through the housing part 19 in an axial direction with reference to the longitudinal axis of the second housing part 20 and is impressed by means of the release tappet 37 either into recess 25 or 25' of the activating lever section, the ball acts as a locking device against an axial shift of the activating lever (24) in the second housing section 20, so that no additional auxiliary fixing device need be supplied. In mounting the activating device 18 on the gas spring, the activating device is bolted with piston 15 of the gas spring, by which means the desired installation force of the release tappet 37 on the ball 38 can be set by means of a counter nut 40.

The mounting of the activating device 18 and with it ultimately also of the corresponding end of the gas spring 10 follows from insertion of the end part 28, 29 of the second housing section 20 into corresponding borings in the side walls 41, 42 of the seat carrier 4, and an axial fixing is effected by means of the snap ring inserted into the grooves 30.

What is claimed is:

1. An activating device for the release tappet of a longitudinally adjustable gas spring, which is shiftable parallel to the longitudinal axis of the gas spring between a fixed position and a release position, the device comprising an activating lever which is positionable in two end positions, wherein means is provided for connecting a piston of the gas spring with a first housing part of the activating device so that a release tappet in the first housing part projects by means of a ball into the first housing part beneath the release tappet and, standing in contact with the ball, by means of a second housing part beneath the first housing part, and by means of a pivotably situated activating lever section in the second housing part beneath the first housing part, the ball remaining in contact with recesses, angularly offset to each other, of different depths.

2. The activating device of claim 1 wherein the activating lever section is stored in a cylindrical boring of the second housing part.

3. The activating device of claim 2 wherein a pivot angle limiting device for the activating lever is arranged for the activating lever in the second housing part.

4. The activating device of claim 3 wherein the pivot angle limiting device is formed such that one end of the second housing part exhibits along the length of a circular chord a diminishing cross section of a boring in the cylinder, and the end of the activating device abutting the chord exhibits a limiting notch such that, between the limiting chord of the cylinder boring and the limiting chord of the end of the activating section, there remains a definable free play for a pivot angle.

5. The activating device of claim 4 wherein at least one end of the second housing is formed as an unscrewable end part.

6. The activating device of claim 5 wherein the end part is unscrewable through a ring groove.

7. The activating device of claim 4 wherein a clear opening of the end part is diminished by rolling.

8. The activating device of claim 1 wherein the first and second housing parts are made in cylindrical form and are welded together.

9. The activating device of claim 1 wherein the connecting device is made as a thread connection with a counter nut.

10. The activating device of claim 1 in combination with a gas spring for damping pivotal movement of the back rest of an office chair.

* * * * *